US010220592B2

(12) United States Patent
Nakano et al.

(10) Patent No.: US 10,220,592 B2
(45) Date of Patent: Mar. 5, 2019

(54) BINDING PROCESSING APPARATUS AND IMAGE FORMING SYSTEM

(71) Applicant: FUJI XEROX CO., LTD., Tokyo (JP)

(72) Inventors: Yoshinori Nakano, Kanagawa (JP); Hiroaki Awano, Kanagawa (JP); Takuya Makita, Kanagawa (JP); Kojiro Tsutsumi, Kanagawa (JP); Katsumi Harada, Kanagawa (JP); Yasuhiro Kusumoto, Kanagawa (JP); Hiroshi Hagiwara, Kanagawa (JP); Emiko Shiraishi, Kanagawa (JP); Junichi Hirota, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 72 days.

(21) Appl. No.: 15/214,557

(22) Filed: Jul. 20, 2016

(65) Prior Publication Data

US 2017/0285549 A1 Oct. 5, 2017

(30) Foreign Application Priority Data

Mar. 29, 2016 (JP) ..... 2016-066617

(51) Int. Cl.
*B31F 5/02* (2006.01)
*B42F 3/00* (2006.01)
(Continued)

(52) U.S. Cl.
CPC ..... *B31F 5/02* (2013.01); *B42B 5/00* (2013.01); *B42C 1/12* (2013.01); *B42C 13/00* (2013.01);
(Continued)

(58) Field of Classification Search
CPC ..... G03G 15/6541; G03G 2215/00852; B31F 1/07; B31F 5/02; B31F 2201/0712;
(Continued)

(56) References Cited

U.S. PATENT DOCUMENTS 8,845,258 B2 * 9/2014 Mori ..... B42B 5/00 412/33
8,983,362 B2 * 3/2015 Nakamura ..... B65H 37/04 270/58.08
(Continued)

FOREIGN PATENT DOCUMENTS

CN 104444548 A 3/2015
JP 2010208854 A 9/2010
(Continued)

OTHER PUBLICATIONS

Communication dated Dec. 27, 2016, from the Japanese Patent Office in counterpart Japanese application No. 2016-066617.
(Continued)

*Primary Examiner* — Leslie A Nicholson, III
(74) *Attorney, Agent, or Firm* — Sughrue Mion, PLLC

(57) ABSTRACT

A binding processing apparatus includes a pair of pressing members each including a concave-convex portion configured to form a concave part and a convex part in a recording material bundle. The concave-convex portion includes protrusion portions. Aside surface of each protrusion portion is inclined so that the protrusion portion is widened from an apex of the protrusion portion. The side surfaces of the protrusion portions of a first pressing member that is one of the pressing members and the side surfaces of the protrusion portions of a second pressing member that is the other of the pressing members intersect with each other during pressing when viewed in a column direction of the protrusion portions.

5 Claims, 9 Drawing Sheets

(51) Int. Cl.

| | |
|---|---|
| ***B42C 1/12*** | (2006.01) |
| ***B42C 13/00*** | (2006.01) |
| ***B65H 5/06*** | (2006.01) |
| ***B65H 29/14*** | (2006.01) |
| ***B65H 37/04*** | (2006.01) |
| ***G03G 15/00*** | (2006.01) |
| ***B42B 5/00*** | (2006.01) |
| ***B65H 31/02*** | (2006.01) |
| ***B65H 31/30*** | (2006.01) |
| ***B65H 31/36*** | (2006.01) |
| ***B65H 31/38*** | (2006.01) |

(52) U.S. Cl.
CPC ..... *B42F 3/00* (2013.01); *B65H 5/062* (2013.01); *B65H 29/14* (2013.01); *B65H 31/02* (2013.01); *B65H 31/3027* (2013.01); *B65H 31/36* (2013.01); *B65H 31/38* (2013.01); *B65H 37/04* (2013.01); *G03G 15/6541* (2013.01); *B65H 2301/4212* (2013.01); *B65H 2301/4213* (2013.01); *B65H 2301/43828* (2013.01); *B65H 2301/51616* (2013.01); *B65H 2404/1114* (2013.01); *B65H 2801/27* (2013.01); *G03G 2215/00852* (2013.01)

(58) Field of Classification Search
CPC ..... B42F 3/00; B65H 37/04; B65H 2801/27; B65H 2301/51616; B65H 2301/43828
USPC ..... 270/58.07, 58.08
See application file for complete search history.

(56) References Cited

U.S. PATENT DOCUMENTS

| | | | | |
|---|---|---|---|---|
| 9,102,492 | B2 * | 8/2015 | Saito | B65H 39/00 |
| 9,254,621 | B2 * | 2/2016 | Takahashi | B42C 13/00 |
| 9,315,356 | B2 * | 4/2016 | Yoshida | B65H 37/04 |
| 2012/0148372 | A1 | 6/2012 | Mori | |
| 2015/0076759 | A1 * | 3/2015 | Kosuge | B42F 1/00 270/1.01 |

FOREIGN PATENT DOCUMENTS

| | | | |
|---|---|---|---|
| JP | 5080691 | B2 | 11/2012 |
| JP | 2014121865 | A | 7/2014 |
| JP | 2015-024891 | A | 2/2015 |
| WO | 2011/018897 | A1 | 2/2011 |

OTHER PUBLICATIONS

Communication dated Oct. 11, 2016, from the Japanese Patent Office in counterpart application No. 2016-066617.
Communication dated May 23, 2018 from the State Intellectual Property Office of the P.R.C. in counterpart application No. 201610810901.6.
Communication dated Nov. 1, 2018, issued by the State Intellectual Property Office of the P.R.C. in corresponding application No. 201610810901.6.

* cited by examiner

BINDING PROCESSING APPARATUS AND IMAGE FORMING SYSTEM

CROSS-REFERENCE TO RELATED APPLICATIONS

This application is based on and claims priority under 35 USC 119 from Japanese Patent Application No. 2016-066617 filed Mar. 29, 2016.

BACKGROUND

Technical Field

The present invention relates to a binding processing apparatus and an image forming system.

SUMMARY

According to an aspect of the invention, a binding processing apparatus includes a pair of pressing members each including a concave-convex portion configured to form a concave part and a convex part in a recording material bundle. The concave-convex portion includes protrusion portions. A side surface of each protrusion portion is inclined so that the protrusion portion is widened from an apex of the protrusion portion. The side surfaces of the protrusion portions of a first pressing member that is one of the pressing members and the side surfaces of the protrusion portions of a second pressing member that is the other of the pressing members intersect with each other during pressing when viewed in a column direction of the protrusion portions.

BRIEF DESCRIPTION OF THE DRAWINGS

Exemplary embodiments of the present invention will be described in detailed based on the following figures, wherein:

FIGS. 7A and 7B are views illustrating another exemplary configuration of the needle-free binding processing apparatus, in which FIG. 7A is a view illustrating a positional relationship between an upper convex portion and a lower convex portion prior to initiating the binding processing, and FIG. 7B is a view illustrating a positional relationship between the upper convex portion and the lower convex portion during the binding processing.

DETAILED DESCRIPTION

Hereinafter, exemplary embodiments of the invention will be described in detail with reference to the accompanying drawings.

Figure 1:
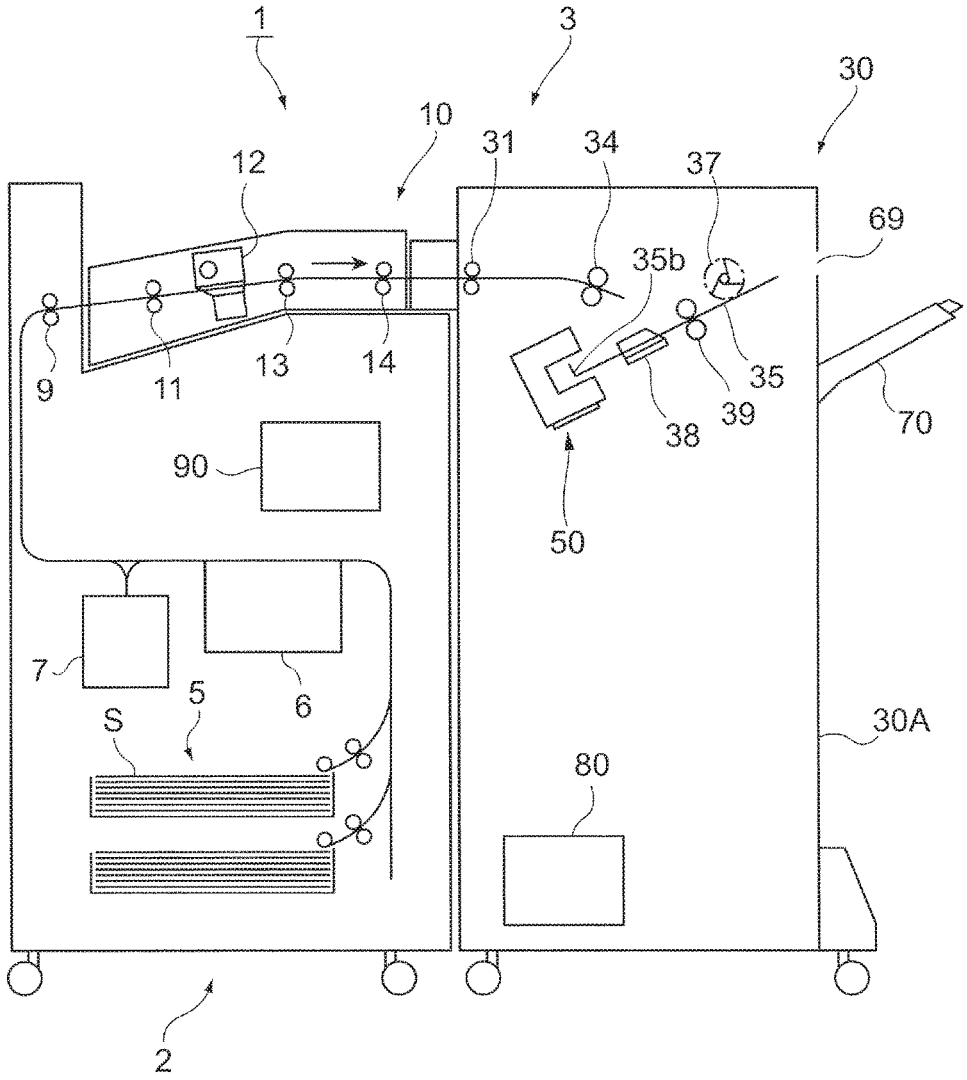
FIG. 1 is a view illustrating an exemplary configuration of an image forming system of an exemplary embodiment of the invention.

FIG. 1 is a view illustrating an exemplary configuration of an image forming system 1 of an exemplary embodiment of the invention.

The image forming system 1 illustrated in FIG. 1 includes an image forming device 2, such as a printer or a copier, that forms an image by, for example, an electrophotographic method, and a sheet processing device 3 that performs a post-processing for a sheet S as an example of a recording material on which, for example, a toner image is formed by the image forming device 2.

The image forming device 2 includes a sheet supply unit 5 that supplies a sheet S on which an image is to be formed, and an image forming unit 6 that forms an image on the sheet S supplied from the sheet supply unit 5.

Further, the image forming device 2 includes a sheet reversing device 7 that reverses the surface of the sheet S on which an image has been formed by the image forming unit 6, and a discharge roll 9 that discharges the sheet S formed with the image thereon.

Further, the image forming device 2 includes a user interface 90 that receives information about the binding processing from a user.

The sheet processing device 3 includes a conveyer 10 that conveys the sheet S output from the image forming device 2 further to a downstream side, and a post-processing device 30.

Further, the sheet processing device 3 includes a controller 80 that controls the entire image forming system 1.

The conveyer 10 includes entrance rolls 11, which are a pair of rolls, and a puncher 12. The entrance rolls 11 receive the sheet S output through the discharge rolls 9 of the image forming device 2. The puncher 12 punches the sheet S received by the entrance rolls 11 as needed.

Further, the conveyer 10 includes first conveyance rolls 13 that are a pair of rolls configured to convey the sheet S further to the downstream side of the puncher 12, and second conveyance rolls 14 that are a pair of rolls configured to convey the sheet S toward the post-processing device 30.

The post-processing device 30 includes reception rolls 31 that are a pair of rolls configured to receive the sheet S conveyed from the conveyer 10.

Further, the post-processing device 30 includes a compiling stack unit 35 and exit rolls 34 that are a pair of rolls. The compiling stack unit 35 is provided at the downstream side of the reception rolls 31 and collects and accommodates plural sheet S thereon. The exit rolls 34 discharge the sheets S toward the compiling stack unit 35.

Further, the post-processing device 30 includes a paddle 37 that is rotated to cause the sheets S to be pressed and pushed toward an end guide 35*b* (to be described later) of the compiling stack unit 35, a tamper 38 configured to align the ends of the sheets S, and ejection rolls 39. The ejection rolls 39 press the sheets S accumulated on the compiling stack unit 35 and are rotated thereby conveying a sheet bundle as an example of a bound recording material bundle.

Further, the post-processing device 30 is equipped with a needle-free binding processing apparatus 50 that binds the end of the sheet bundle accumulated on the compiling stack unit 35. In the present exemplary embodiment, the needle-free binding processing apparatus 50 is disposed at one end side of the compiling stack unit 35 in the longitudinal direction thereof (at the side provided with the end guide 35*b* to be described later).

Further, the post-processing device 30 includes a housing 30A that accommodates therein the above-described respective members. The housing 30A includes an opening 69. The opening 69 is provided to discharge the sheet bundle bound by the needle-free binding processing apparatus 50 to the outside of the post-processing device 30 by the ejection roll 39.

Further, the post-processing device 30 includes a stack unit 70 that superimposes thereon the sheet bundle discharged from the opening 69 of the housing 30A such that the user may easily take the sheet bundle.

Figure 2:
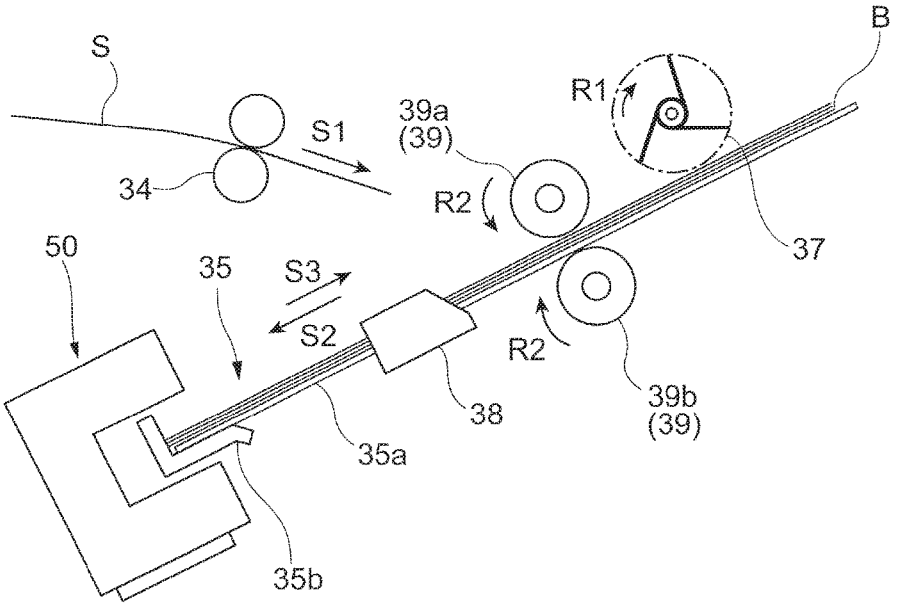
FIG. 2 is a view illustrating a peripheral structure of a compiling stack unit.

FIG. 2 is view illustrating a peripheral structure of the compiling stack unit 35.

As illustrated in FIG. 2, the compiling stack unit 35 is provided with a bottom unit 35*a* having a top surface on which sheets S are stacked. The bottom unit 35*a* is inclined to cause the sheets S to move along the top surface thereof. The sheets S conveyed toward the compiling stack unit 35 (the sheets S conveyed in the direction S1 in FIG. 2) by the exit rolls 34 are stacked on the bottom unit 35*a*.

Further, the compiling stack unit 35 is provided with the end guide 35*b*. The end guide 35*b* aligns the distal ends of the sheets S moving along the bottom unit 35*a* in the moving direction (the sheets S moving in the direction S2 in FIG. 2).

The paddle 37 is disposed above the compiling stack unit 35 and at the downstream side in the direction S1 in FIG. 2 with respect to the exit roll 34.

When the paddle 37 is rotated clockwise in FIG. 2 (in the direction of the arrow R1 of FIG. 2), the sheets S that have been conveyed along the direction S1 in FIG. 2 are pressed and pushed in the direction S2 in FIG. 2 on the compiling stack unit 35.

The tamper 38 is provided at each of one end side of the compiling stack unit 35 in the width direction thereof (in the direction intersecting with the moving direction S2 in FIG. 2) and the other end side thereof to sandwich the compiling stack unit 35 therebetween. The tamper 38 is driven by, for example, a motor (not illustrated) to move in the width direction of the compiling stack unit 35. Then, the tamper 38 aligns one side end and the other side end of the sheets S (in the width direction of the compiling stack unit 35) on the compiling stack unit 35.

The ejection rolls 39 are provided with a first ejection roll 39*a* and a second ejection roll 39*b*.

The first ejection roll 39*a* and the second ejection roll 39*b* are arranged to be opposite to each other via the bottom unit 35*a* of the compiling stack unit 35.

The first ejection roll 39*a* is provided on the front surface of the compiling stack unit 35 (the surface on which the sheets S are stacked).

The second ejection roll 39*b* is provided on the rear surface of the compiling stack unit 35 (the surface opposite to the surface on which the sheets S are stacked).

The first ejection roll 39*a* and the second ejection roll 39*b* are driven by, for example, a motor (not illustrated) in a state of being in contact with the sheets S to be rotated in the direction of the arrow R2 of FIG. 2. Then, a sheet bundle B is conveyed in the direction S3 in FIG. 2.

Figure 3:
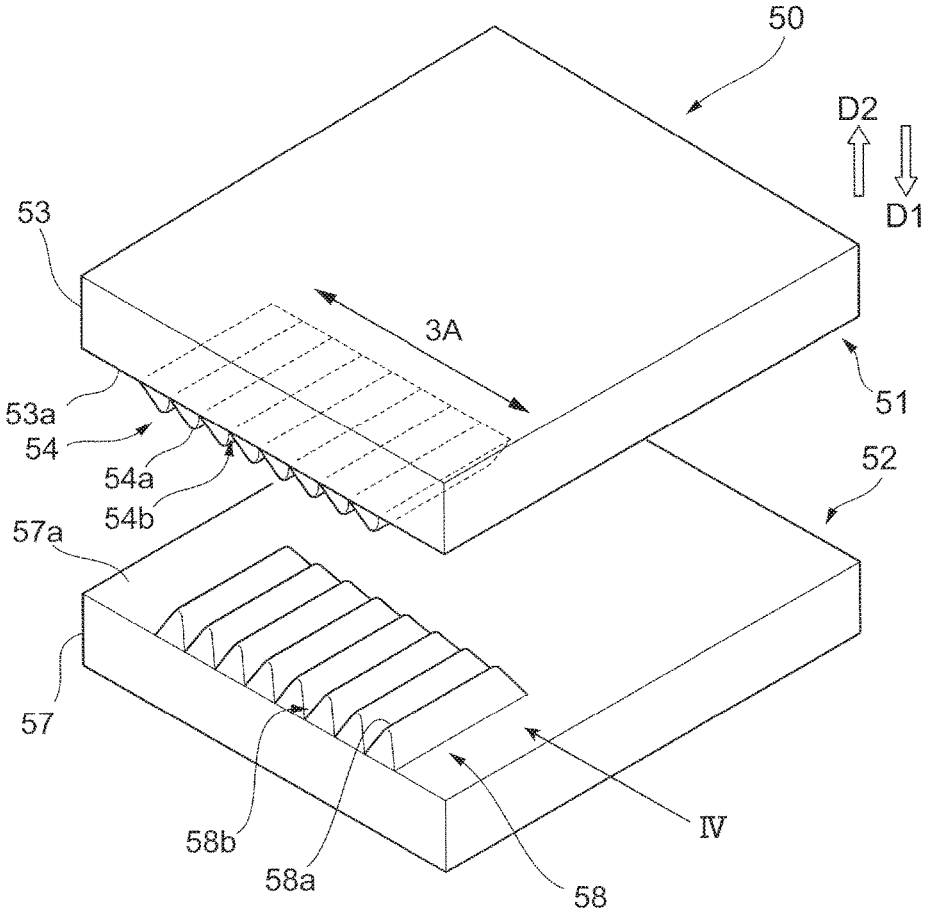
FIG. 3 is a perspective view illustrating a configuration of a needle-free binding processing apparatus.
Figure 4:
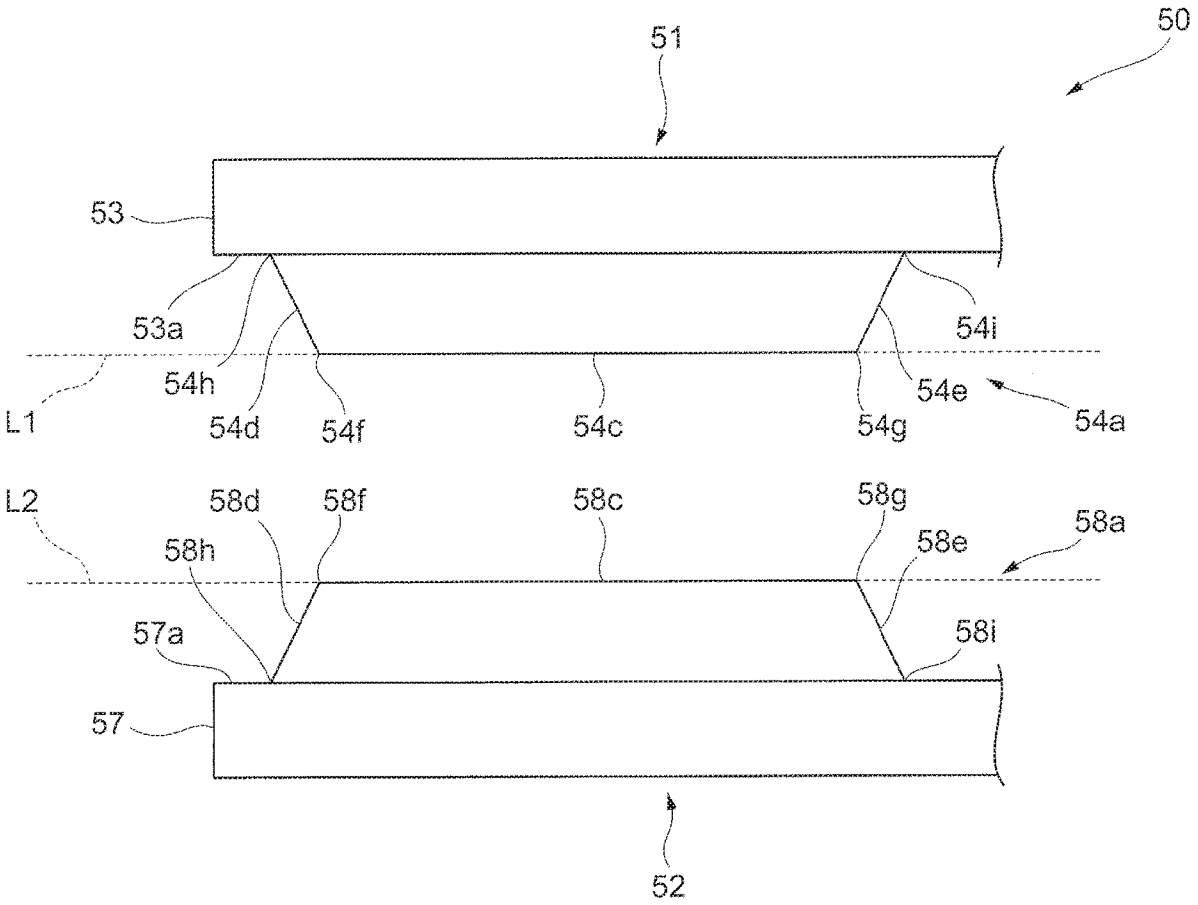
FIG. 4 is a view illustrating the needle-free binding processing apparatus when viewed in the direction of the arrow IV in FIG. 3.

FIG. 3 is a perspective view illustrating a configuration of the needle-free binding processing apparatus 50. FIG. 4 is a view when the needle-free binding processing apparatus 50 is viewed from the direction of the arrow IV of FIG. 3.

As illustrated in FIG. 3, the needle-free binding processing apparatus 50 is provided with an upper pressing member 51. Further, the needle-free binding processing apparatus 50 is provided with a lower pressing member 52 that is paired with the upper pressing member 51 and disposed to be opposite to the upper pressing member 51.

The upper pressing member 51 is provided to be movable forward and backward (see the arrows D1 and D2 in FIG. 3) with respect to the lower pressing member 52 when a cam (not illustrated) driven by a motor (not illustrated) is rotated.

The upper pressing member 51 is provided with an upper base portion 53 and an upper concave-convex portion 54 that protrudes from the upper base portion 53. The upper concave-convex portion 54 is provided to extend along one direction (in the direction of the arrow 3A in FIG. 3).

Further, the upper concave-convex portion 54 is provided with plural upper convex portions 54*a* and plural of upper concave portions 54*b*.

The plural upper convex portions 54*a* are arranged side by side in the longitudinal direction of the upper concave-convex portion 54.

Further, the upper convex portions 54*a* protrude downwardly from the surface 53*a* of the upper base portion 53. The upper convex portions 54*a* are formed along the short length direction of the upper concave-convex portion 54 (the direction intersecting with the longitudinal direction of the upper concave-convex portion 54).

Each of the upper concave portions 54*b* is formed between two adjacent upper convex portions 54*a* in the longitudinal direction of the upper concave-convex portion 54. In addition, the upper convex portions 54*a* and the upper concave portions 54*b* are alternately arranged in the longitudinal direction of the upper concave-convex portion 54.

The lower pressing member 52 is provided with a lower base portion 57 and a lower concave-convex portion 58 that protrudes from the lower base portion 57. The lower concave-convex portion 58 is provided to extend along the longitudinal direction of the upper concave-convex portion 54.

Further, the lower concave-convex portion 58 is provided with plural lower convex portions 58*a* and plural lower concave portions 58*b*.

The upper convex portions 54*a* and the lower convex portions 58*a* are exemplary protrusion portions. The upper concave portions 54*b* and the lower concave portions 58*b* are exemplary valley portions.

The plural lower convex portions 58*a* are arranged side by side in the longitudinal direction of the lower concave-convex portion 58.

Further, the lower convex portions 58*a* protrude upwardly from the surface 57*a* of the lower base portion 57. The lower convex portions 58*a* are formed along the short length direction of the lower concave-convex portion 58 (the direction intersecting with the longitudinal direction of the lower concave-convex portion 58).

Each of the lower concave portions 58*b* is formed between two adjacent lower convex portions 58*a* in the longitudinal direction of the lower concave-convex portion 58. In addition, the lower convex portions 58*a* and the lower concave portions 58*b* are alternately arranged in the longitudinal direction of the lower concave-convex portion 58.

When the upper concave-convex portion 54 of the upper pressing member 51 meshes with the lower concave-convex portion 58 of the lower pressing member 52 via the sheet bundle B (see FIG. 2), the sheet bundle B is pressed, and concave parts and convex parts are formed in the sheet bundle B.

Accordingly, the respective sheets S of the sheet bundle B (mutually adjacent sheets S within the sheet bundle B) are pressed and bound to each other.

In addition, as illustrated in FIG. 4, an upper convex portion 54*a* of the upper pressing member 51 is provided with an upper apex 54*c* at the lower end side thereof in FIG. 4.

Further, the upper convex portion 54*a* is provided with an upper left side wall 54*d* at one end side in the longitudinal direction thereof.

The upper left side wall 54*d* is connected to the upper apex 54*c* of the upper convex portion 54*a* at the lower end side thereof in FIG. 4. Further, the upper left side wall 54*d* is connected to the surface 53*a* of the upper base portion 53 at the upper end side thereof in FIG. 4.

The upper left side wall 54*d* is inclined to approach the central portion side of the upper convex portion 54*a* in the longitudinal direction thereof as the distance from the surface 53*a* of the upper base portion 53 increases. In other words, the lateral surface of one end side of the upper convex portion 54*a* in the longitudinal direction thereof is inclined such that the upper convex portion 54*a* is widened toward the surface 53*a* of the upper base portion 53 from the upper apex 54*c*.

Further, the upper convex portion 54*a* is provided with an upper right side wall 54*e* at the other end side of the upper convex portion 54*a* in the longitudinal direction thereof.

The upper right side wall 54*e* is connected to the upper apex 54*c* at the lower end side thereof in FIG. 4. Further, the upper right side wall 54*e* is connected to the surface 53*a* of the upper base portion 53 at the upper end side thereof in FIG. 4.

The upper right side wall 54*e* is inclined to approach the central portion side of the upper convex portion 54*a* in the longitudinal direction thereof as the distance from the surface 53*a* of the upper base portion 53 increases. In other words, the lateral surface of the other end side of the upper convex portion 54*a* in the longitudinal direction thereof is inclined such that the upper convex portion 54*a* is widened toward the surface 53*a* of the upper base portion 53 from the upper apex 54*c*.

Further, the upper pressing member 51 is provided with a left upper apex side intersection 54*f* at one end side of the upper convex portion 54*a* in the longitudinal direction thereof. The left upper apex side intersection 54*f* is located at a position where a straight line L1 extending along the longitudinal direction of the upper convex portion 54*a*, as a straight line passing through the upper apex 54*c* and the upper left side wall 54*d* intersect with each other.

Further, the upper pressing member 51 is provided with a right upper apex side intersection 54*g* at the other end side of the upper convex portion 54*a* in the longitudinal direction thereof. The right upper apex side intersection 54*g* is located at a position where the straight line L1 and the upper right side wall 54*e* intersect with each other.

Further, the upper pressing member 51 is provided with a left upper base portion side intersection 54*h* at one end side of the upper convex portion 54*a* in the longitudinal direction thereof. The left upper base portion side intersection 54*h* is located at a position where the upper left side wall 54*d* and the surface 53*a* of the upper base portion 53 intersect with each other.

Further, the upper pressing member 51 is provided with a right upper base portion side intersection 54*i* at the other end side of the upper convex portion 54*a* in the longitudinal direction thereof. The right upper base portion side intersection 54*i* is located at a position where the upper right side wall 54*e* and the surface 53*a* of the upper base portion 53 intersect with each other.

Next, the lower pressing member 52 will be described.

A lower convex portion 58*a* of the lower pressing member 52 is provided with a lower apex 58*c* at the upper end side thereof in FIG. 4.

Further, the lower convex portion 58*a* is provided with a lower left side wall 58*d* at one end side of the lower convex portion 58*a* in the longitudinal direction thereof.

The lower left side wall 58*d* is connected to the lower apex 58*c* of the lower convex portion 58*a* at the upper end side thereof in FIG. 4. In addition, the lower right side wall 58*d* is connected to the surface 57*a* of the lower base portion 57 at the lower end side thereof in FIG. 4.

The lower left side wall 58*d* is inclined to approach the central portion side of the lower convex portion 58*a* in the longitudinal direction thereof as the distance from the surface 57*a* of the lower base portion 57 increases. In other words, the lateral surface of one end side of the lower convex portion 58*a* in the longitudinal direction thereof is inclined such that the lower convex portion 58*a* is widened toward the surface 57*a* of the lower base portion 57 from the lower apex 58*c*.

Further, the lower convex portion 58*a* is provided with a lower right side wall 58*e* at the other end side of the lower convex portion 58*a* in the longitudinal direction thereof.

The lower right side wall 58*e* is connected to the lower apex 58*c* at the upper end side thereof in FIG. 4. In addition, the lower right side wall 58*e* is connected to the surface 57*a* of the lower base portion 57 at the lower end side thereof in FIG. 4.

The lower right side wall 58*e* is inclined to approach the central portion side of the lower convex portion 58*a* in the longitudinal direction thereof as the distance from the surface 57*a* of the lower base portion 57 increases. In other words, the lateral surface of the other end side of the lower convex portion 58*a* in the longitudinal direction thereof is inclined such that the lower convex portion 58*a* is widened toward the surface 57*a* of the lower base portion 57 from the lower apex 58*c*.

Further, the lower pressing member 52 is provided with a left lower apex side intersection 58*f* at one end side of the lower convex portion 58*a* in the longitudinal direction thereof. The left lower apex side intersection 58*f* is located at a position where a straight line L2 extending along the longitudinal direction of the lower convex portion 58*a*, as a straight line passing through the lower apex 58*c*, and the lower left side wall 58*d* intersect with each other.

Further, the lower pressing member 52 is provided with a right lower apex side intersection 58*g* at the other end side of the lower convex portion 58*a* in the longitudinal direction thereof. The right lower apex side intersection 58*g* is located at a position where the straight line L2 and the lower right side wall 58*e* intersect with each other.

Further, the lower pressing member 52 is provided with a left lower base portion side intersection 58*h* at one end side of the lower convex portion 58*a* in the longitudinal direction thereof. The left lower base portion side intersection 58*h* is located at a position where the lower left side wall 58*d* and the surface 57*a* of the lower base portion 57 intersect with each other.

Further, the lower pressing member 52 is provided with a right lower base portion side intersection 58*i* at the other end side of the lower convex portion 58*a* in the longitudinal direction thereof. The right lower base portion side intersection 58*i* is located at a position where the lower right side wall 58*e* and the surface 57*a* of the lower base portion 57 intersect with each other.

In the present exemplary embodiment, the position of the left upper apex side intersection 54*f* is aligned with the position of the left lower apex side intersection 58*f* in the longitudinal direction of the upper convex portion 54*a*.

In addition, the position of the right upper apex side intersection 54*g* is aligned with the position of the right lower apex side intersection 58*g* in the longitudinal direction of the upper convex portion 54*a*.

In the present exemplary embodiment, the position of the left upper base portion side intersection 54*h* is aligned with the position of the left lower base portion side intersection 58*h* in the longitudinal direction of the upper convex portion 54*a*.

In addition, the position of the right upper base portion side intersection 54*i* is aligned with the position of the right lower base portion side intersection 58*i* in the longitudinal direction of the upper convex portion 54*a*.

In the present exemplary embodiment, the left upper apex side intersection 54*f* is located closer to the central portion side of the upper convex portion 54*a* in the longitudinal direction thereof than the left lower base portion side intersection 58*h*.

In addition, the right upper apex side intersection 54*g* is located closer to the central portion side of the upper convex portion 54*a* in the longitudinal direction thereof than the right lower base portion side intersection 58*i*.

The left lower apex side intersection 58*f* is located closer to the central portion side of the lower convex portion 58*a* in the longitudinal direction thereof than the left upper base portion side intersection 54*h*.

In addition, the right lower apex side intersection 58*g* is located closer to the central portion side of the lower convex portion 58*a* in the longitudinal direction thereof than the right upper base portion side intersection 54*i*.

Figure 5A:
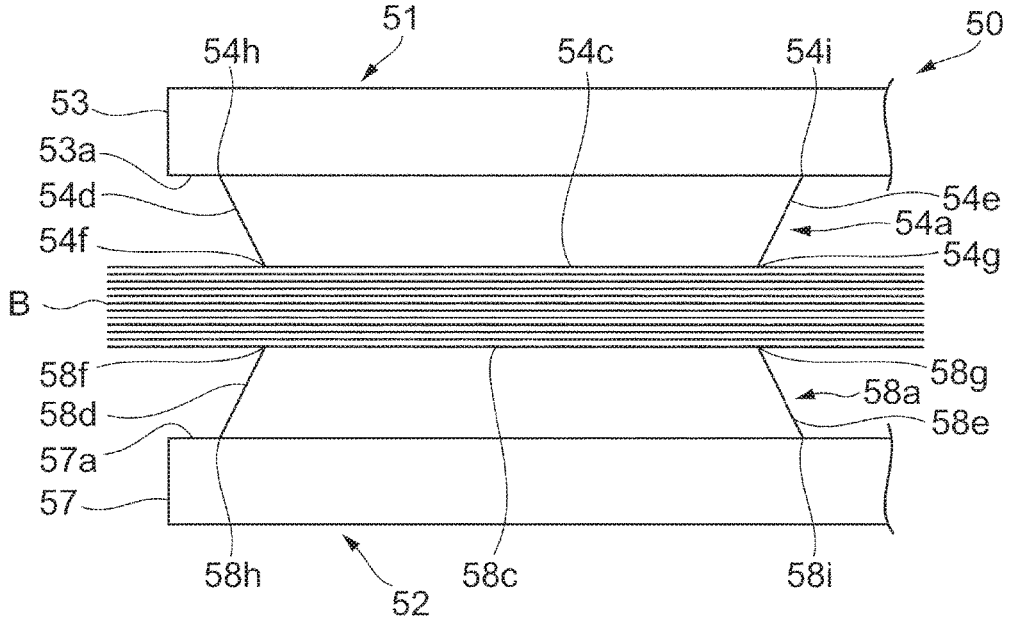
FIGS. 5A to 5C are views illustrating an operation of the needle-free binding processing apparatus at the time of the binding processing.
Figure 5B:
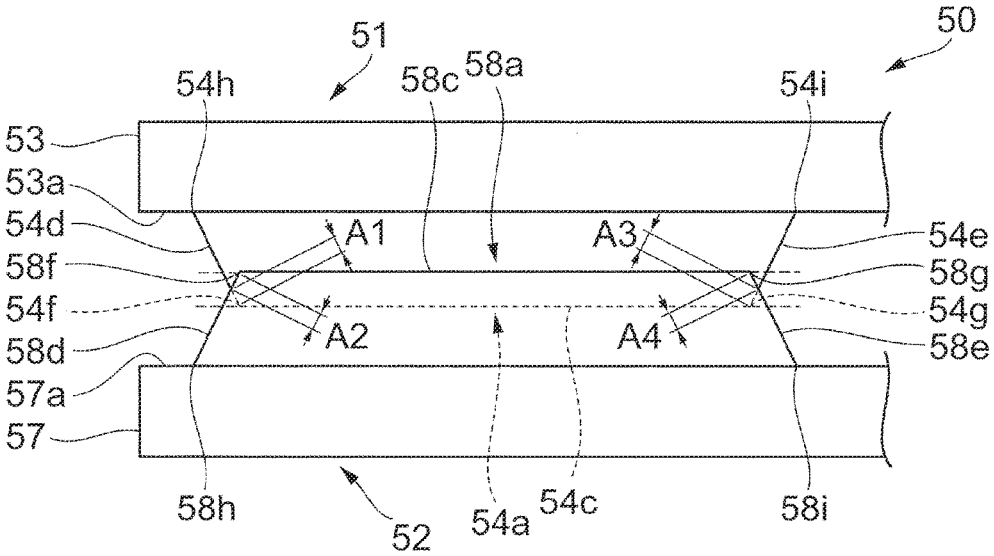
Figure 5C:
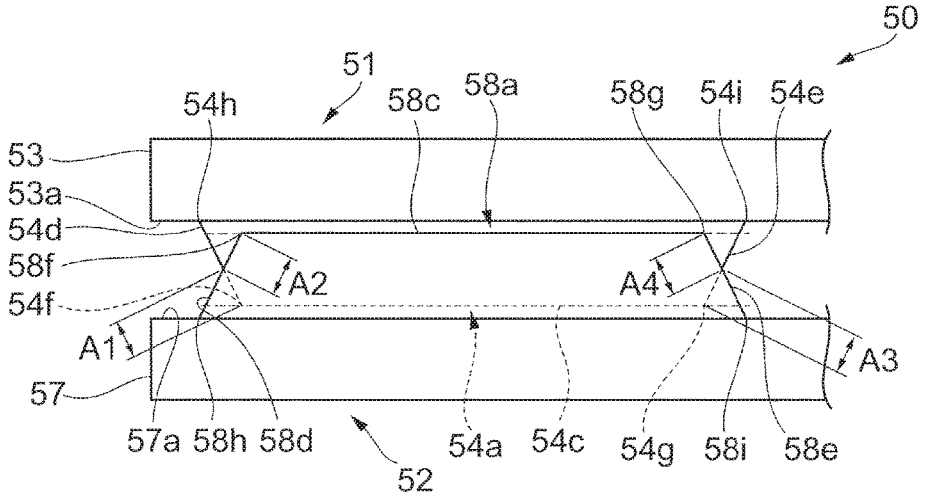

FIGS. 5A to 5C are views illustrating an operation of the needle-free binding processing apparatus 50 at the time of binding. FIGS. 5B and 5C omit illustration of the sheet bundle B. In FIGS. 5A to 5C, the upper convex portion 54*a* is located more rearward on the paper surface of FIGS. 5A to 5C than the lower convex portion 58*a*.

As illustrated in FIG. 5A, the upper pressing member 51 moves downwardly toward the lower pressing member 52. When the upper pressing member 51 moves downwardly, the upper apex 54*c* of the upper convex portion 54*a* and the lower apex 58*c* of the lower convex portion 58*a* press the sheet bundle B.

Thereafter, as illustrated in FIG. 5B, the upper pressing member 51 further moves downwardly. When the upper pressing member 51 further moves downwardly, the upper apex 54*c* arrives at a lower side of the lower apex 58*c* while pressing the sheet bundle B.

When the upper apex 54*c* arrives at a lower side of the lower apex 58*c*, the upper left side wall 54*d* and the lower left side wall 58*d* intersect with each other when seen from the front side of the paper surface of FIG. 5B. Further, the upper right side wall 54*e* and the lower right side wall 58*e* intersect with each other. In other words, when viewed in the column direction of the upper convex portion 54*a* (the direction in which the plural upper convex portions 54*a* are arranged) (when viewed from the upstream or downstream side in the column direction), the lateral surface of one end side of the upper convex portion 54*a* in the longitudinal direction thereof and the lateral surface of one end side of the lower convex portion 58*a* in the longitudinal direction thereof intersect with each other, during the pressing of the sheet bundle B. Likewise, the lateral surface of the other end side of the upper convex portion 54*a* in the longitudinal direction thereof and the lateral surface of the other end side of the lower convex portion 58*a* in the longitudinal direction thereof intersect with each other.

As the upper left side wall 54*d* and the lower left side wall 58*d* intersect with each other, an area A1 pressing the sheet bundle B is generated in the upper left side wall 54*d*. Further, an area A2 pressing the sheet bundle B is generated in the lower left side wall 58*d*.

As the upper right side wall 54*e* and the lower right side wall 58*e* intersect with each other, an area A3 pressing the sheet bundle B is generated in the upper right side wall 54*e*. Further, an area A4 pressing the sheet bundle B is generated in the lower right side wall 58*e*.

As a result, the portion of the sheet bundle B pressed by the upper convex portion 54*a* is widened in the longitudinal direction of the upper convex portion 54*a*. Here, in the present exemplary embodiment, since a portion of the upper left side wall 54*d* and a portion of the upper right side wall 54*e*, in addition to the upper apex 54*c*, are also adapted to press the sheet bundle B, the portion of the sheet bundle B pressed by the upper convex portion 54*a* is widened in the longitudinal direction of the upper convex portion 54*a*.

Likewise, the portion of the sheet bundle B pressed by the lower convex portion 58*a* is widened in the longitudinal direction of the lower convex portion 58*a*. Additionally, since a portion of the lower left side wall 58*d* and a portion of the lower right side wall 58*e*, in addition to the lower apex 58*c*, are also adapted to press the sheet bundle B, as in the upper convex portion 54*a*, the portion of the sheet bundle B pressed by the lower convex portion 58*a* is widened in the longitudinal direction of the lower convex portion 58*a*.

Subsequently, as illustrated in FIG. 5C, the upper pressing member 51 further moves downwardly. Even when the upper pressing member 51 further moves downwardly, the intersection relationship between the upper left side wall 54*d* and the lower left side wall 58*d* when viewed from the front side of the paper of FIG. 5C is continued. Further, the intersection relationship between the upper right side wall 54*e* and the lower right side wall 58*e* is also continued.

Accordingly, the range of the area A1 of the upper left side wall 54*d*, which presses the sheet bundle B, is further widened. The range of the area A2 of the lower left side wall 58*d*, which presses the sheet bundle B, is also further widened. The range of the area A3 of the upper right side wall 54*e*, which presses the sheet bundle B, is also widened. The range of the area A4 of the lower right side wall 58*e*, which presses the sheet bundle B, is also widened.

As a result, the portion of the sheet bundle B pressed by the upper convex portion 54*a* is further widened in the longitudinal direction of the upper convex portion 54*a*. In addition, the portion of the sheet bundle B pressed by the lower convex portion 58*a* is further widened in the longitudinal direction of the lower convex portion 58*a*.

Then, in the present exemplary embodiment, when the upper pressing member 51 reaches a predetermined position, the binding processing of the sheet bundle B is ended.

In the present exemplary embodiment, when the binding processing is started, the upper apex 54*c* of the upper convex portion 54*a* first presses the sheet bundle B. Further, the lower apex 58*c* of the lower convex portion 58*a* presses the sheet bundle B.

Here, in the present exemplary embodiment, when the upper apex 54*c* presses the sheet bundle B, a load may be easily concentrated in the portion of the sheet bundle B pressed by the left upper apex side intersection 54*f* and the portion of the sheet bundle B pressed by the right upper apex side intersection 54*g*.

In addition, when the lower apex 58*c* presses the sheet bundle B, a load may be easily concentrated in the portion of the sheet bundle B pressed by the left lower apex side intersection 58*f* and the portion of the sheet bundle B pressed by the right lower apex side intersection 58*g*.

Then, when the upper pressing member 51 further moves downwardly in the state in which the load is concentrated in this way, a damage to the sheet bundle B may occur at the portions of the sheet bundle B pressed by the left upper apex side intersection 54*f*, the right upper apex side intersection 54*g*, the left lower apex side intersection 58*f*, and the right lower apex side intersection 58*g*.

In contrast, in the present exemplary embodiment, as described above, the portions of the sheet bundle B pressed by the upper pressing member 51 and the lower pressing member 52 are gradually widened in the direction that the upper convex portion 54*a* extends and in the direction that the lower convex portion 58*a* extends, according to the further movement of the upper pressing member 51.

As a result, the load acting on the sheet bundle B is distributed so that a damage to the sheet bundle B is difficult to occur.

In addition, in the exemplary embodiment, as illustrated in FIG. 5B, the side walls (the upper left side wall 54*d* and the upper right side wall 54*e*) of the upper convex portion 54*a* and the side walls (the lower left side wall 58*d* and the lower right side wall 58*e*) of the lower convex portion 58*a* intersect with each other during the binding.

Accordingly, the load acting on the specific portions of the sheet bundle B is mitigated.

Here, for example, when the side walls of the upper convex portion 54*a* and the side walls of the lower convex portion 58*a* do not intersect with each other at the time of the binding, a load easily intensively acts on the specific portions of the sheet bundle B.

Figure 6A:
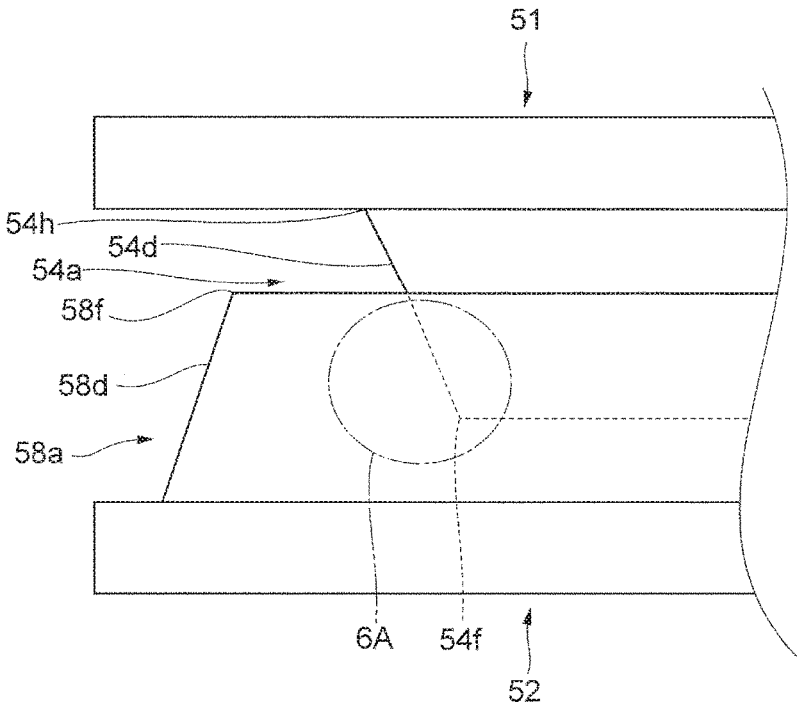
FIG. 6A is a view illustrating a configuration in a case where an upper left side wall and a lower left side wall do not intersect with each other at the time of the binding processing.

FIG. 6A is a view illustrating a configuration of a case where the upper left side wall 54*d* and the lower left side wall 58*d* do not intersect with each other at the time of binding.

In the configuration illustrated in FIG. 6A, both the left upper base portion side intersection 54*h* and the left upper apex side intersection 54*f* are located more rightward in FIG. 6A than the left lower apex side intersection 58*f*, and the upper left side wall 54*d* and the lower left side wall 58*d* do not intersect with each other.

In this configuration, a load easily intensively acts on the portion of the sheet bundle B (not illustrated) pressed by the left upper apex side intersection 54*f*, and for example, a sheet damage easily occurs at the portion.

In the configuration illustrated in FIG. 6A, when the upper pressing member 51 moves downwardly, a portion of the sheet bundle B is pressed from the lower side against the left upper apex side intersection 54*f*. In this case, the lower convex portion 58*a* of the lower pressing member 52 is brought into a state of being located at each of the opposite sides of the portion of the sheet bundle B pressed by the left upper apex side intersection 54*f* (the rear side and the front side of the paper surface of FIG. 6A). Further, an escape space of the portion pressed by the left upper apex side intersection 54*f* is difficult to be provided.

In other words, in the configuration illustrated in FIG. 6A, a wall portion of the lower convex portion 58*a* is provided at each of the opposite sides of the portion of the sheet bundle B pressed by the left upper apex side intersection 54*f* (the rear side and the front side of the paper surface of FIG. 6A) as represented by a reference numeral 6A. The sheet bundle B is confined by the wall portion and easily strongly pressed against the left upper apex side intersection 54*f*.

Figure 6B:
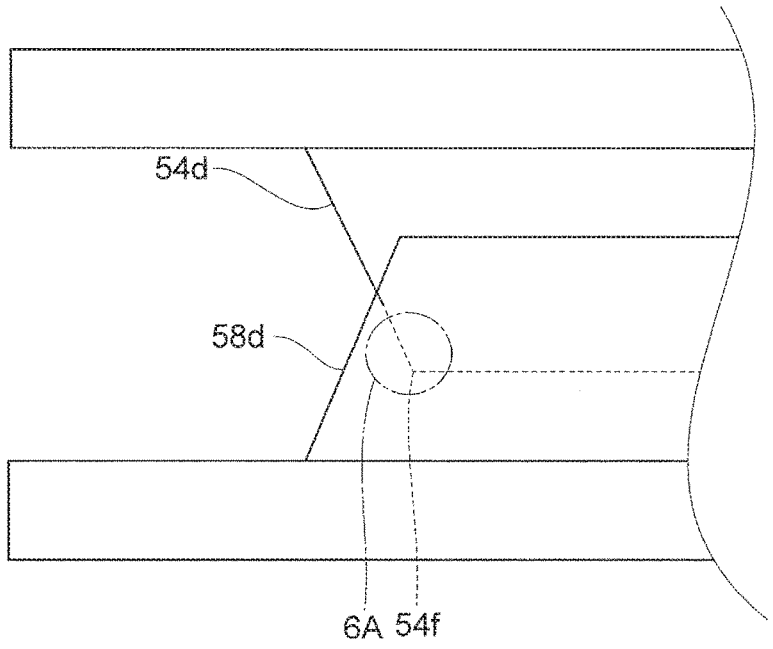
FIG. 6B is a view illustrating a configuration of the exemplary embodiment of the invention.

In contrast, in the configuration in which the upper left side wall 54*d* and the lower left side wall 58*d* intersect with each other as in the present exemplary embodiment, the area of the wall portion located at each of the opposite sides of the left upper apex side intersection 54*f* is reduced, as illustrated by the reference numeral 6A in FIG. 6B.

In this case, the escape space of the portion of the sheet bundle B pressed by the left upper apex side intersection 54*f* is easily provided so that the load acting on the pressed portion is mitigated. Further, in this case, a sheet damage is also difficult to occur.

Here, in the present exemplary embodiment, the intersection relationship between the side walls (the upper left side wall 54*d* and the upper right side wall 54*e*) of the upper convex portion 54*a* and the side walls (the lower left side wall 58*d* and the lower right side wall 58*e*) of the lower convex portion 58*a* is continued until the binding is ended as illustrated in FIG. 5C.

Accordingly, the occasion that a load intensively acts on the specific portions of the sheet bundle B is difficult to occur, compared to the configuration in which the intersection relationship of the side walls is terminated during the binding.

In the present exemplary embodiment, as illustrated in FIG. 4, the position of the left upper apex side intersection 54*f* is aligned with the position of the left lower apex side intersection 58*f* in the longitudinal direction of the upper convex portion 54*a*.

In this case, the load acting on the sheet bundle B is distributed to the left upper apex side intersection 54*f* and the left lower apex side intersection 58*f*. When the position of the left upper apex side intersection 54*f* and the position of the left lower apex side intersection 58*f* are not aligned with each other (when the positions are not aligned with each other in the longitudinal direction of the upper convex portion 54*a*), the contact pressure between one of the apex side intersections and the sheet bundle B may become larger than the contact pressure between the other apex side intersection and the sheet bundle B. In this case, a sheet damage or the like may occur at the side where the contact pressure is relatively high.

In contrast, when the positions of the two apex side intersections are aligned with each other as in the present exemplary embodiment, the load is distributed to the apex side intersections so that a damage to the sheet bundle B is difficult to occur.

In addition, the other end side of the upper convex portion 54*a* in the longitudinal direction thereof is also the same as described above, and the position of the right upper apex side intersection 54*g* and the position of the right lower apex side intersection 58*g* are aligned with each other.

Figure 7A:
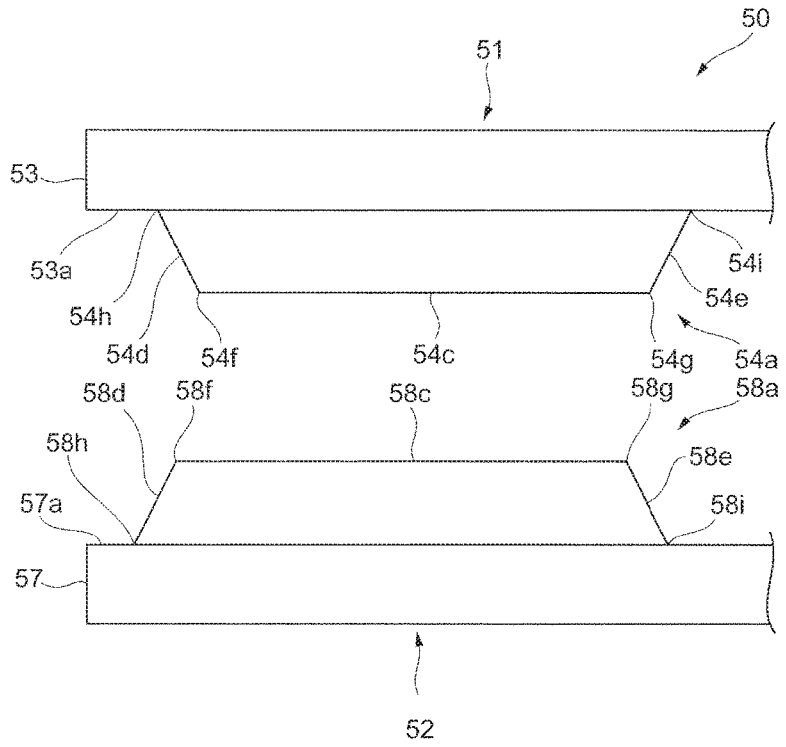
Figure 7B:
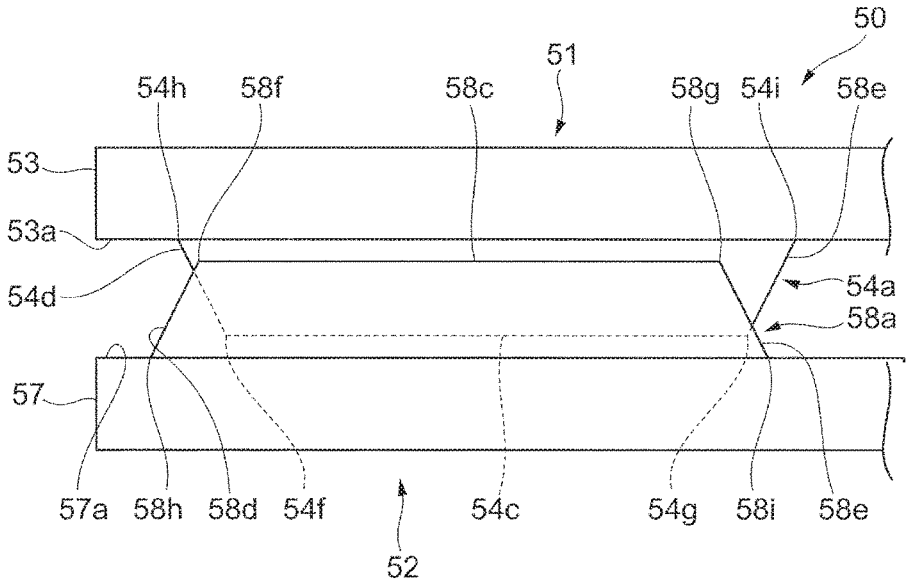

FIGS. 7A and 7B are views illustrating another exemplary configuration of the needle-free binding processing apparatus 50. Here, FIG. 7A is a view illustrating a positional relationship between the upper convex portion 54*a* and the lower convex portion 58*a* prior to start of binding. FIG. 7B is a view illustrating a positional relationship between the upper convex portion 54*a* and the lower convex portion 58*a* during binding. In addition, the components having the same functions as illustrated in FIG. 4 will be denoted by the same reference numerals as used in FIG. 4.

As illustrated in FIG. 7A, in this exemplary configuration, the lower convex portion 58*a* is located more leftward in FIG. 7A than the upper convex portion 54*a*.

Further, as illustrated in FIG. 7B, in this exemplary configuration as well, the sidewalls of the upper convex portion 54*a* and the side walls of the lower convex portion 58*a* intersect with each other during the binding, and this relationship is continued until the binding is ended.

Thus, in this exemplary configuration as well, a load intensively acting on a portion of the sheet bundle B is suppressed as described above.

Figure 8:
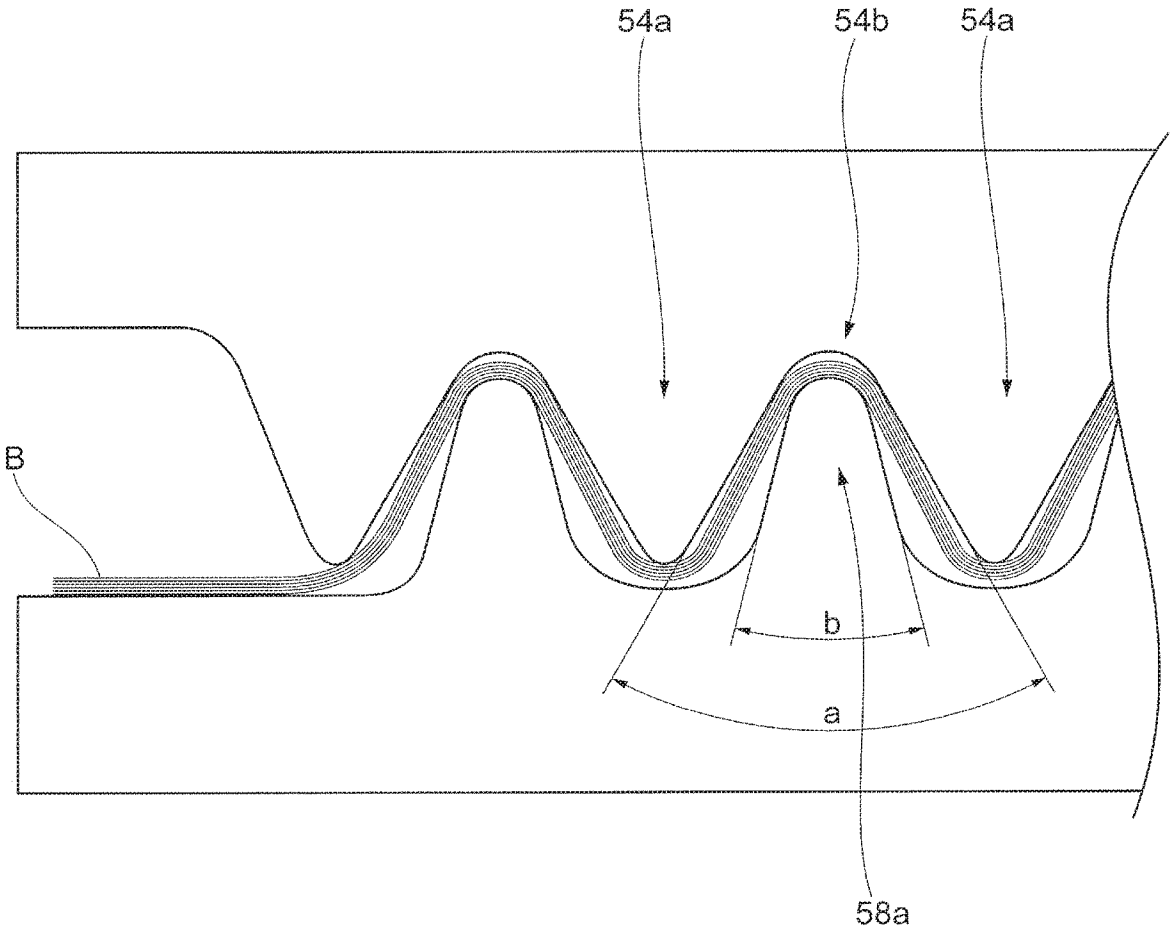
FIG. 8 is a view illustrating another exemplary configuration of the needle-free binding processing apparatus.

FIG. 8 is a view illustrating another exemplary configuration of the needle-free binding processing apparatus 50, and a view when the needle-free binding processing apparatus 50 is viewed from one end side of the upper concave-convex portion 54 in the short length direction thereof. The components having the same functions as illustrated in FIGS. 3 and 4 will be denoted by the same reference numerals as used in FIGS. 3 and 4.

In this exemplary configuration, with respect to an upper opening angle a of the upper recess 54*b* and a lower apex angle b of the lower convex portion 58*a*, the following relationship is established: the upper opening angle a>the lower apex angle b.

Here, the upper opening angle a is an angle formed by a side surface of the upper convex portion 54*a* and a side surface of another adjacent upper convex portion 54*a*.

Further, the lower apex angle b is an angle formed by one side surface of the lower convex portion 58*a* and the other side surface thereof.

In this exemplary configuration, an acting load per unit area as a load acting on the sheet bundle B increases, compared to a case where the upper opening angle a and the lower apex angle b are equal to each other.

In this case, a reduction of the load required for the binding of the sheet bundle B can be implemented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding processing apparatus comprising:

a pair of pressing members each including a concave-convex portion configured to form a concave part and a convex part in a recording material bundle, wherein the concave-convex portion includes protrusion portions, side surfaces of each protrusion portion being inclined so that the protrusion portion is widened from an apex of the protrusion portion, wherein the binding processing apparatus is configured such that the side surfaces of the protrusion portions of a first pressing member, that is one of the pressing members, and the side surfaces of the protrusion portions of a second pressing member, that is another of the pressing members, intersect with each other at first point and second point during pressing when viewed in a column direction of the protrusion portions, and wherein the binding processing apparatus is configured such that the first point and the second point are nearer to the apex of different ones of the pressing members, respectively.

2. The binding processing apparatus according to claim 1, wherein each of the protrusion portions which are provided in the first and second pressing members includes an apex side intersection at which a straight line passing through the apex of the protrusion portion and extending along a longitudinal direction of the protrusion portion and the side surface of the protrusion portion intersect with each other, and wherein the first point and the second point are nearer to the apex side intersections of different ones of the pressing members, respectively.

3. A binding processing apparatus comprising:

a pair of pressing members each including a concave-convex portion configured to form a concave part and a convex part in a recording material bundle, wherein the concave-convex portion includes protrusion portions, side surfaces of each protrusion portion being inclined so that the protrusion portion is widened from an apex of the protrusion portion, wherein the binding processing apparatus is configured such that the side surfaces of the protrusion portions of a first pressing member, that is one of the pressing members, and the side surfaces of the protrusion portions of a second pressing member, that is another of the pressing members, intersect with each other at first point and second point during pressing when viewed in a column direction of the protrusion portions, wherein the binding processing apparatus is configured such that each of the protrusion portions which are provided in the first and second pressing members includes an apex side intersection at which a straight line passing through the apex of the protrusion portion and extending along a longitudinal direction of the protrusion portion and the side surface of the protrusion portion intersect with each other, and wherein the binding processing apparatus is configured such that the apex side intersection of the first pressing member nearest the first point and the apex side intersection of the second pressing member nearest the first point are provided at different points in the longitudinal direction.

4. The binding processing apparatus according to claim 1, wherein apex angles of convex portions provided in at least one of the first and second pressing members are smaller than an opening angle of a valley portion located between the protrusion portions provided in the other of the first and second pressing members.

5. The binding processing apparatus according to claim 3, wherein apex angles of convex portions provided in at least one of the first and second pressing members are smaller than an opening angle of a valley portion located between the protrusion portions provided in the other of the first and second pressing members.

* * * * *